US006901877B1

(12) United States Patent
Winnett

(10) Patent No.: US 6,901,877 B1
(45) Date of Patent: Jun. 7, 2005

(54) FOAM BLOCK REPLACEMENT BARGE

(76) Inventor: Michael Winnett, 3708 Treaty Rd., Calera, OK (US) 74730

( * ) Notice: Subject to any disclaimer, the term of this patent is extended or adjusted under 35 U.S.C. 154(b) by 0 days.

(21) Appl. No.: 10/679,995

(22) Filed: Oct. 7, 2003

(51) Int. Cl.[7] ..... B63B 27/00; B65G 67/60
(52) U.S. Cl. ..... 114/268; 414/137.7
(58) Field of Search ..... 114/263, 268, 382, 114/331, 49, 52; 212/307; 405/219, 220; 414/137.1, 137.7

(56) References Cited

U.S. PATENT DOCUMENTS 3,741,143 A * 6/1973 McKinley et al. ..... 114/268
3,955,522 A 5/1976 Gaudiano et al.
4,018,179 A * 4/1977 Rutter ..... 114/45
4,159,692 A 7/1979 Dye, Jr.
4,394,841 A * 7/1983 Lundback ..... 114/26
4,556,341 A * 12/1985 Ayers ..... 405/195.1
4,606,469 A * 8/1986 Van Deijk ..... 212/256
4,898,288 A 2/1990 Erdbrink
5,937,784 A 8/1999 Beers
6,718,903 B1 * 4/2004 Moise et al. ..... 114/265
6,755,142 B2 * 6/2004 Rice ..... 114/61.1

* cited by examiner

*Primary Examiner*—Andrew D. Wright
(74) *Attorney, Agent, or Firm*—Molly D. McKay

(57) ABSTRACT

A barge for replacing foam blocks that support floating docks. The barge is provided with a float sinker that removably attaches to the barge via a boom. The float sinker can be moved from side to side via the boom and can be rotated. The float sinker has clamp arms with movable flat plates for releasably grasping foam blocks. The float sinker has hollow chambers that can be flooded as a means of pulling the blocks downward in the water and has means for expelling the water from the chambers to allow the blocks to rise to the surface of the water. Controls are provided on the deck of the barge for operating the barge and for remotely operating the float sinker from the barge.

4 Claims, 6 Drawing Sheets

FOAM BLOCK REPLACEMENT BARGE

BACKGROUND OF THE INVENTION

1. Field of the Invention

The present invention relates to a foam block replacement barge that is designed for use in replacing foam block floatation material that is employed to support floating docks, marinas, and boat houses commonly found on inland lakes and rivers.

2. Description of the Related Art

Floating docks, marinas, and boat houses can be found in abundance on inland lakes and rivers. The floating structures are supported on the water by employing a plurality of blocks of floatation material that are secured together and onto which the floating structures are built using conventional methods. The most common type of floatation material is foam blocks. Although these foam blocks come in various sizes, the normal size is 2 feet tall, 3 feet wide, and 8 feet long.

Over time, these foam blocks deteriorate due chiefly to the action of light, water and physical abrasion on the blocks. As the blocks deteriorate, they gradually lose their ability to support the floating structure that is built on top of them. For this reason, it is necessary to periodically replace one or more of the foam blocks that support a floating structure.

However, replacing the foam blocks is not an easy task. Obviously, the floating structure that is supported by the foam blocks can not be raised or removed to get to the foam blocks. And because the blocks are buoyant, they can not easily be pulled downward in the water to extract them from their position under the floating structure. To more easily remove the blocks, they can be cut into smaller pieces and then the pieces can be removed. However, if the blocks are cut, this causes debris from the old blocks to be released into the water. Also, if the old foam blocks have been successfully removed from under the floating structure, the new blocks must then be pulled downward in the water to insert them under the floating structure in the space that the old blocks had previously occupied.

To remove the older blocks and insert new blocks requires that a diver go under the floating structure and attach cables to the blocks to remove the old blocks and then again to guide the new blocks into place under the floating structure that is supported by the blocks. In cooler climates, the cold temperature of the water can make this an uncomfortable job for the diver and can also limit the periods during the year when this job can be done. This makes removal and replacement of the foam blocks a time consuming and expensive operation.

Because of the difficulty in both removing the old blocks and then inserting new replacement block, currently old blocks are rarely removed. Instead, new blocks are normally added at the sides of existing blocks. This is done by first adding additional angle iron runners or track for the new block to slide into and adding a metal frame to the new block. Then the new block is moved along the runners by using a winch to pull the block under the runners and into position so that the new block helps to support the structure.

One problem with this method of adding new blocks to the existing older blocks is that the floatation base becomes wider and wider until the base limits access to the floating structure via the water.

Another problem with the current method is that because the old blocks are not removed from the floating structure, the old blocks gradually deteriorate. The old blocks are ugly and detract from the appearance of the structure. The deteriorating blocks with eventually break into pieces that will drift out into the body of water, thereby adding to the debris that is floating on the water and that accumulates on the shore of the body of water.

Still another problem with the current method is that these deteriorating old blocks tend to become waterlogged and loose their buoyancy, thus becoming less and less able to support the floating structure. As the deteriorating old blocks lose their ability to support the floating structure, the floating structure actually sinks lower and lower into the water. When blocks become waterlogged, their reduced ability to support the floating structure can let the metal framework of the floating structure sink below the water line. This accelerates the process of rusting and corrosion, and if allowed to remain in this condition, can eventually damage the floating structure to the point that it is too costly to repair and must be dismantled and removed from the water.

A further problem is that older types of foam blocks are susceptible to chemical degradation by fuel used by boats that accidentally is spilled into the water. When the fuel contacts the unprotected float blocks, the foam melts at the water level. Newer plastic coated or encapsulated foam blocks are much more resistant to chemical attack by fuel that may have been spilled in the water. Those newer types of encapsulated foam blocks are also less likely to become waterlogged.

The present invention addresses these problems by providing a barge with a float sinker that is able to easily grasp and remove old blocks of foam from under a floating structure and replace them with new foam blocks. One advantage of the present invention is that the operator of the barge replaces foam blocks while remaining safely on the deck of the barge. The barge is provided with a boom that extends between the float sinker and the barge so that the float sinker can be remotely maneuvered and operated by the operator who is located on the deck of the barge. Because the operator is not required to enter the water in order to replace foam blocks, the season during which replacement work can be done is greatly extended. Using the present invention, the replacement procedure can be performed at any time that the weather is not threatening and the water is not frozen.

Another advantage of the present invention is that foam blocks can be quickly and easily located and positioned under a floating structure by use of the float sinker. The barge is provided with a float sinker with arms for releasably grasping the blocks. The float sinker can be flooded to pull the blocks downward in the water and the water can be pushed out of the float sinker to allow the blocks to again rise to the surface.

Still a further advantage of the present invention is that the barge makes the removal and replacement of old foam blocks fast and economical, thus enabling the owner of the floating structure to afford to replace old blocks instead of allowing them to remain in the water where they fall apart and add to the floating debris on the water.

Another advantage of the present invention is that it is designed with plates on its clamp arms that allow it to hold and to install the new encapsulated blocks with minimal side squeezing force exerted on the block, thereby reducing the chance of cracking the encapsulating plastic shell of this type of floatation block.

Still another advantage of the present invention is that the float sinker can be detached from the barge and loaded onto the deck of the barge for transport, allowing the barge to be transported on a trailer from one location to another. This enables a single barge to service floating structures that are located on more than one body of water. This increases the customer base for each barge, making the barge more profitable and thereby further reducing the cost for replacing foam blocks for any one floating structure.

SUMMARY OF THE INVENTION

The present invention is a barge for replacing foam blocks that support floating structures, such as floating docks, marinas, and boat houses commonly found on inland lakes and rivers. The barge is self contained, including propellers for moving the barge in the water and for guiding the motion of the barge as it moves through the water. The barge is also provided with a motor that provides the hydraulic fluid to operate the barge and its associated float sinker.

The barge is provided with a float sinker that removably attaches to the barge via a boom. The float sinker can be detached from the barge and loaded onto the deck of the barge for transport, or alternately, the float sinker can be attached for use to the barge via the boom. The float sinker can be moved from side to side by moving the boom from side to side. Also, the float sinker can be rotated by employing a hydraulic motor located at the bottom of the float sinker for this purpose.

The float sinker has clamp arms with movable flat plates for releasably grasping the blocks. The float sinker is provided with hollow chambers that can be flooded as a means for pulling the blocks downward in the water and has means for expelling the water from the chambers in order to allow the blocks to again rise to the surface of the water.

The barge is provided with controls so that an operator can operate the barge and can remotely operate the float sinker from the deck of the barge.

DETAILED DESCRIPTION OF THE PREFERRED EMBODIMENT THE INVENTION

Figure 1:
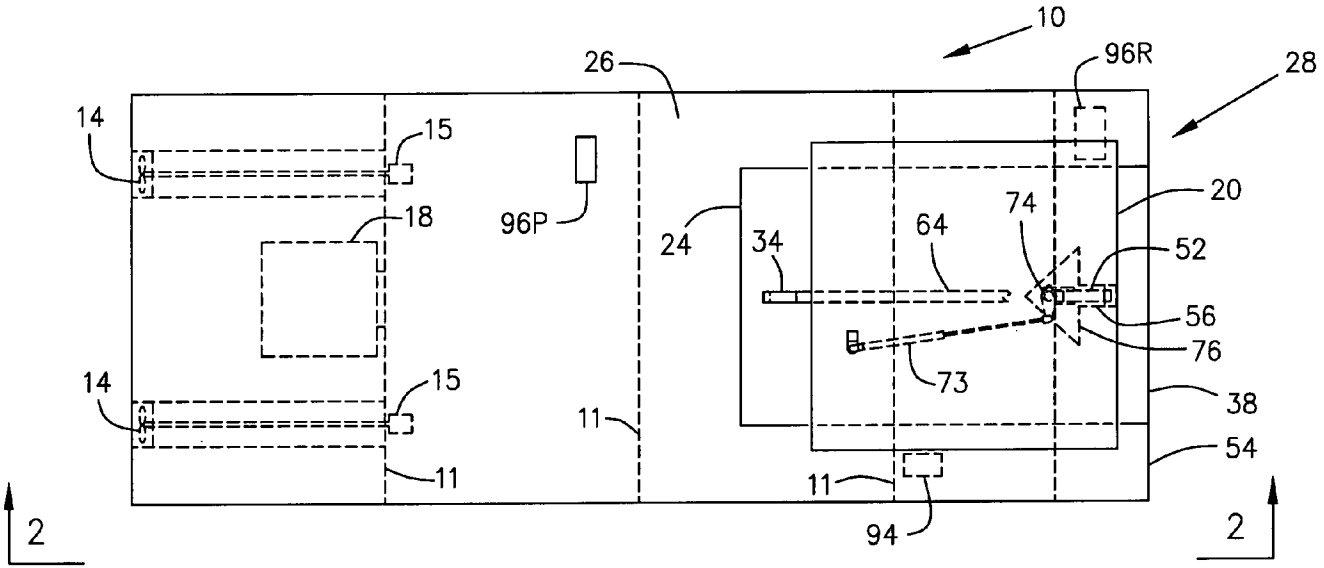
FIG. 1 is a top plan view of a foam block replacement barge constructed in accordance with a preferred embodiment of the present invention, shown with its float sinker in its non-deployed position resting on the barge table provided on the deck of the barge.
Figure 2:
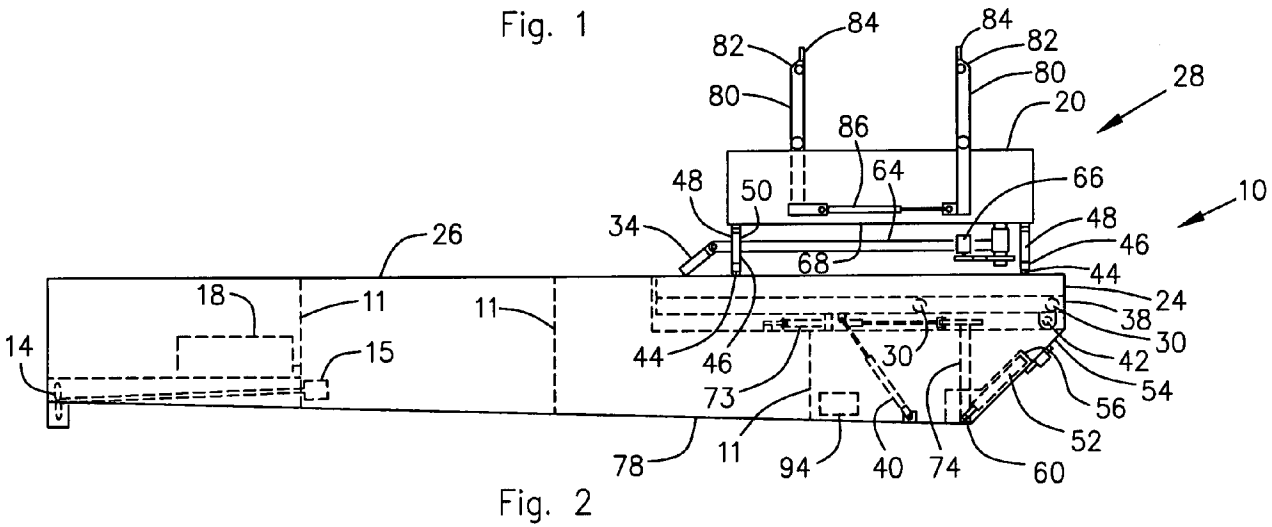
FIG. 2 is a side view of the foam block replacement barge of FIG. 1.

Referring now to the drawings and initially to FIGS. 1 and 2, there is illustrated a barge 10 that is constructed in accordance with a preferred embodiment of the present invention. The barge 10 is designed for replacing foam blocks 12 that support floating structures (not illustrated), such as floating docks, marinas, and boat houses commonly found on inland lakes and rivers. The barge 10 is provided internally with several bulkheads 11 to prevent the barge 10 from sinking in the event the barge 10 becomes damaged. The barge 10 is self contained, and includes propellers 14 for moving the barge 10 in the water 16 and for guiding the motion of the barge 10 as it moves through the water 16. The propellers 14 are powered by propeller motors 15. The barge 10 is also provided with a motor 18 that provides the hydraulic fluid to operate equipment on the barge 10 and equipment on its associated float sinker 20, as will be described more fully hereafter. In the interest of making the illustrations more clear, the hydraulic lines have been omitted from the illustrations since connection of hydraulic lines is commonly known technology.

The barge 10 is provided with an associated float sinker 20 that is removably attachable to the barge 10 via a boom 22. The float sinker 20 can be detached from the barge 10 and loaded onto a barge table 24 provided on a deck 26 of the barge 10 for transport, as illustrated in FIGS. 1 and 2 which illustrate the float sinker 20 in its non-deployed, transport position 28.

Figure 4:
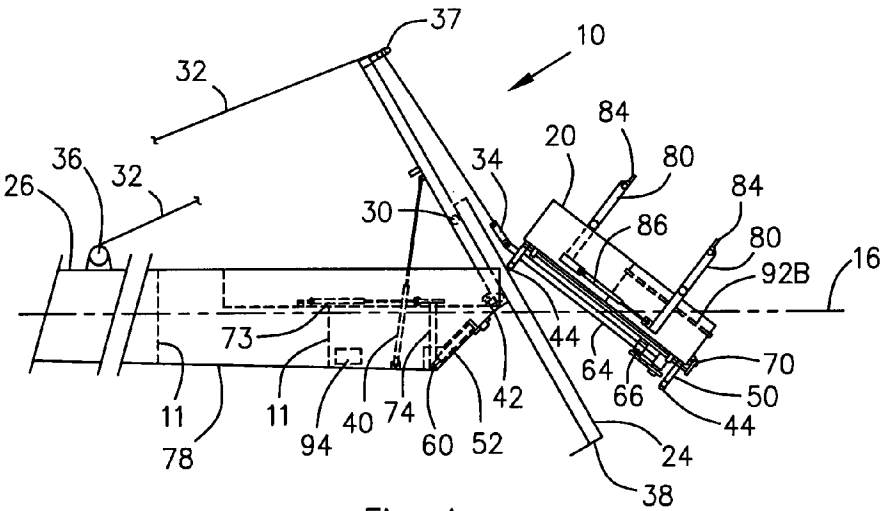
FIG. 4 is a partially cut away side view of the foam block replacement barge of FIG. 3 showing the barge table tilted forward and showing the float sinker beginning to float on the water as it is deployed off of the barge table.
Figure 3:
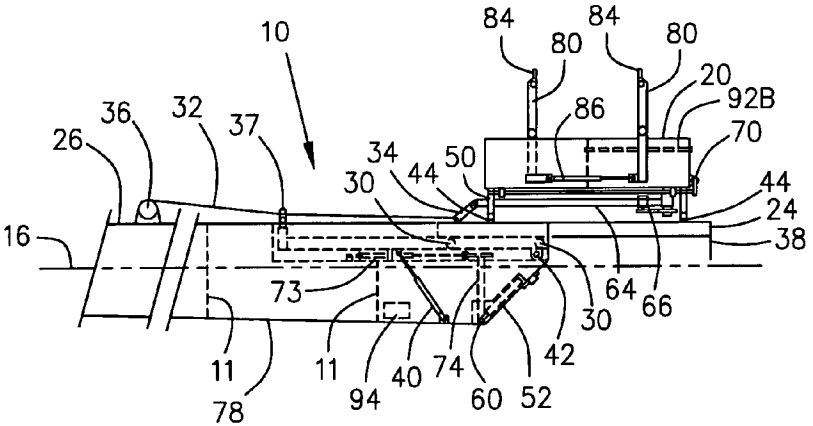
FIG. 3 is a partially cut away side view of the foam block replacement barge of FIG. 2 showing the barge table moving forward on the barge in anticipation of deploying the float sinker.

Alternately, the float sinker 20 can be lowered into the water 16 and attached for use to the barge 10 via the boom 22. FIGS. 3 and 4 illustrate the float sinker 20 being deployed from its non-deployed, transport position 28 into the water 16 from the barge table 24. As illustrated in FIG. 3, the barge table 24 is moved forward on table rollers 30 that support the barge table 24 on the deck 26 of the barge 10. Before the barge table 24 is moved forward and tilted, a winch cable 32 is attached to a float sinker boom segment 34 of the boom 22. The winch cable 32 is secured to a hydraulic winch 36 that attaches to the deck 26 of the barge 10 just behind the barge table 24. The winch cable 32 is passed through a roller fairlead 37 that removably attaches to the barge table 24 to prevent the cable 32 from being pinched as it is used to deploy the float sinker 20. The winch cable 32 serves first to hold the float sinker 20 on the barge table 24 as the barge table 24 is moved forward relative to the barge 10 and then as a front end 38 of the barge table 24 is tilted downward by a hydraulic barge table cylinder 40 located under the barge table 24. The barge table 24 is attached to the barge 10 at a pivot point 42 and the barge table 24 pivots at this pivot point 42 in response to activation of the hydraulic barge table cylinder 40.

The winch cable 32 is thereafter gradually released from the hydraulic winch 36, thereby controlling the descent of the float sinker 20 as it enters the water 16, as illustrated in FIG. 4. Leg rollers 44 are provided on the lower end 46 of each of four legs 48 of the landing gear 50. The leg rollers 44 serve to support the float sinker 20 above the barge table 24 when the float sinker 20 is resting on the barge table 24 and serve to allow the float sinker 20 to smoothly roll down the tilted barge table 24 during deployment.

Also, once the float sinker 20 is floating on the water 16, the winch cable 32 remains attached to the float sinker boom segment 34 while the barge table 24 is once again returned to its non-deployed, transport position 28 on the deck 26 of the barge 10 by again activating the hydraulic barge table cylinder 40. By remaining attached to the float sinker boom segment 34, the winch cable 32, thereby prevents the float sinker 20 from floating away from the barge 10. The winch cable 32 remains attached to the float sinker boom segment 34 until the operator is ready to attach the float sinker boom segment 34 to a boom rotator segment 52 of the boom 22 that is provided on the front end 54 of the barge 10.

Figure 5:
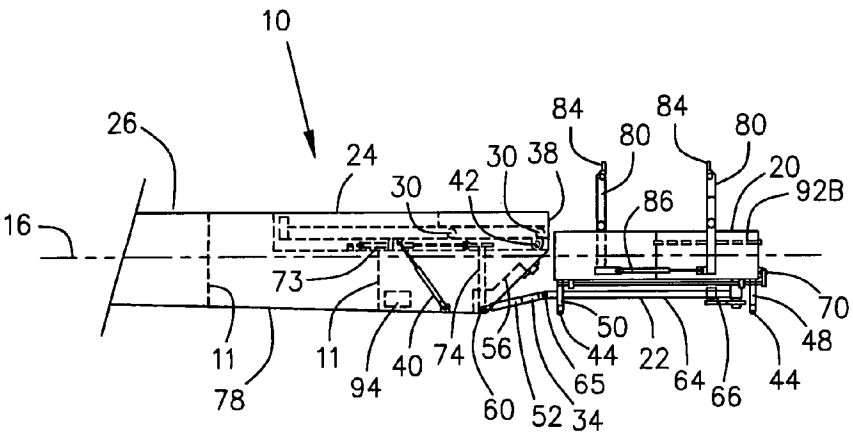
FIG. 5 is a partially cut away side view of the foam block replacement barge of FIG. 4 showing the boom of the float sinker boom segment attached to the boom rotator segment provided on the front and bottom of the barge.

FIG. 5 illustrates the float sinker boom segment 34 on the boom 22 of the float sinker 20 being attached to the boom rotator segment 52 provided on the front end 54 of the barge 10. When not in use, the boom rotator segment 52 is secured in a recessed area 56 at the front end 54 of the barge 10. Although not illustrated, a detachable step can be attached to the front end 54 of the barge 10 for the operator to stand on while he connects together the boom rotator segment 52 and the float sinker boom segment 34 to thereby join together the boom 22. The detachable step (not illustrated) provides the operator a stable platform on which to stand and provides easier access while assembling the boom 22. To prevent shoes and clothing from becoming wet while connecting the boom 22, the operator must wear a pair of fishing waders while standing on the detachable step, since the step is at or slightly below the level of the water 16. At the same time the operator is attaching the boom 22 together, he will also attach the necessary hydraulic and air lines that connect between the barge 10 and the float sinker 20.

Figure 6:
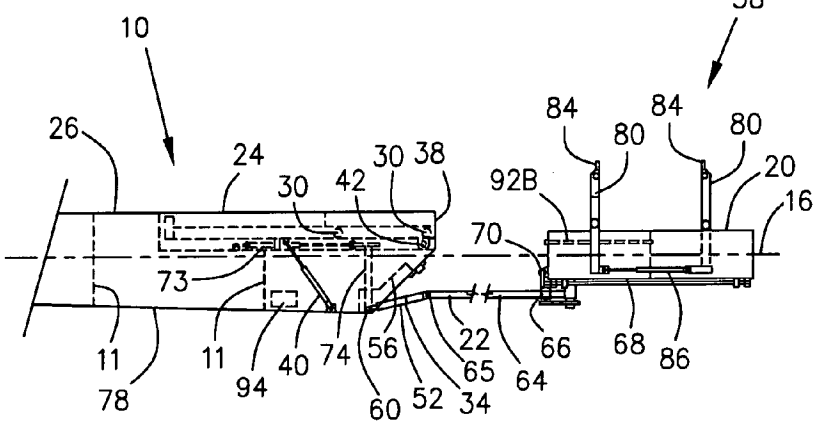
FIG. 6 is a partially cut away side view of the foam block replacement barge of FIG. 5 showing the landing gear on the float sinker retracted against the bottom of the float sinker and the float sinker rotated horizontally 180 degrees, placing the float sinker in its deployed position.

FIG. 6 illustrates the float sinker 20 with its landing gear 50 raised and with the float sinker 20 in its fully deployed, in use position 58, i.e. after the float sinker 20 has been rotated 180 degrees from the orientation illustrated in FIG. 5. Although not illustrated, an extension boom can be added between the boom rotator segment 52 and the float sinker boom segment 34 as a means of lengthening the boom 22 when additional boom length is needed.

Figure 8:
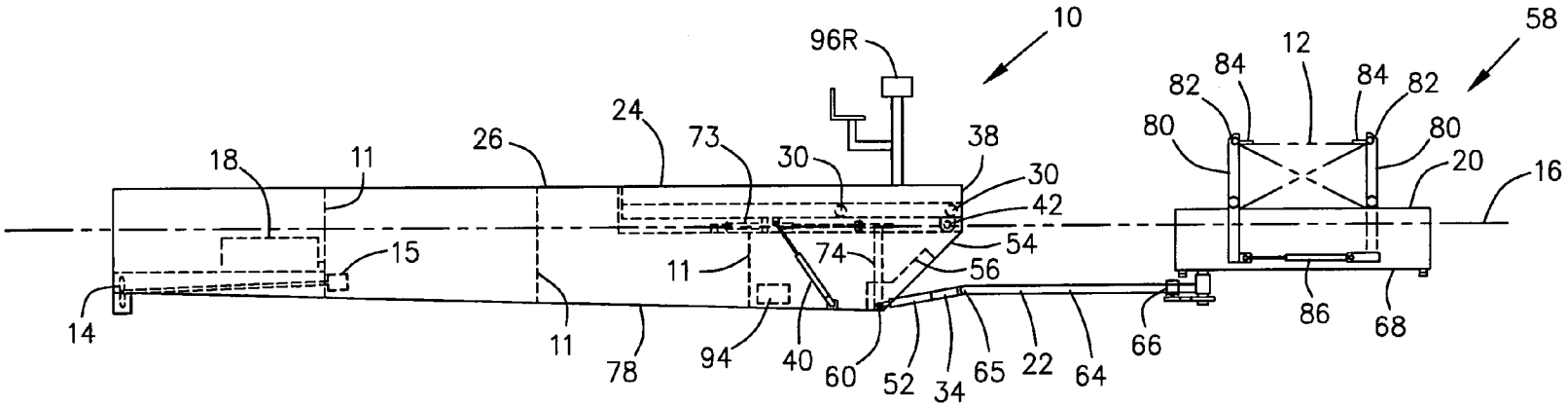
FIG. 8 is a partially cut away side view of the foam block replacement barge of FIG. 7 showing the removable control center attached to the front of the deck and showing the float sinker raised in order to secure a new foam block between the clamp arms of the float sinker.
Figure 9:
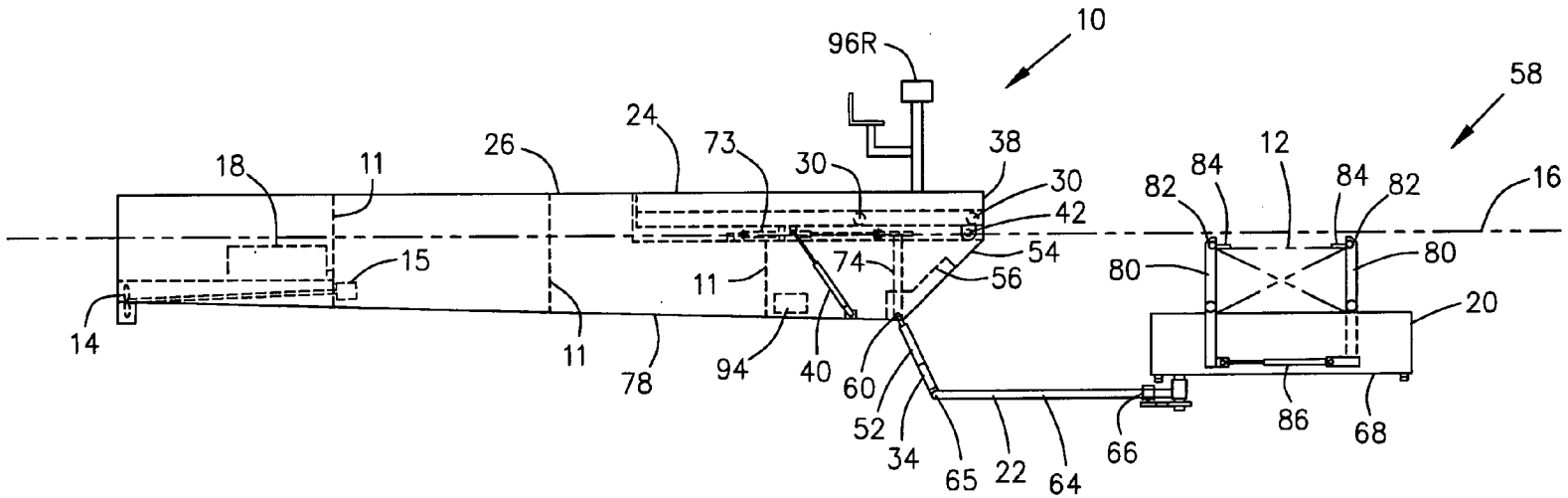
FIG. 9 is a partially cut away side view of the foam block replacement barge of FIG. 8 showing the float sinker and attached foam block submerged below the water level.

The boom rotator segment 52 attaches to the barge 10 via an articulating joint 60 that allows the boom 22 to move freely upward and downward. This joint 60 is a safety feature that prevents the barge 10 from being capsized in the event that the float sinker 20 would suddenly sink in the water 16, such as might occur if the float sinker were to lose air pressure to its floatation chambers 62A and 62B. As illustrated in FIGS. 8 and 9, there is also a second articulating joint 65 provided between the float sinker boom segment 34 and a boom segment 64 that allows the float sinker 20 to move upward and downward in the water 16 while allowing the boom segment 64 to remain approximately horizontal. The boom segment 64 attaches on one end to the float sinker boom segment 34 and on an opposite end to a hydraulic rotator motor 66 provided on a bottom 68 of the float sinker 20.

Figure 10:
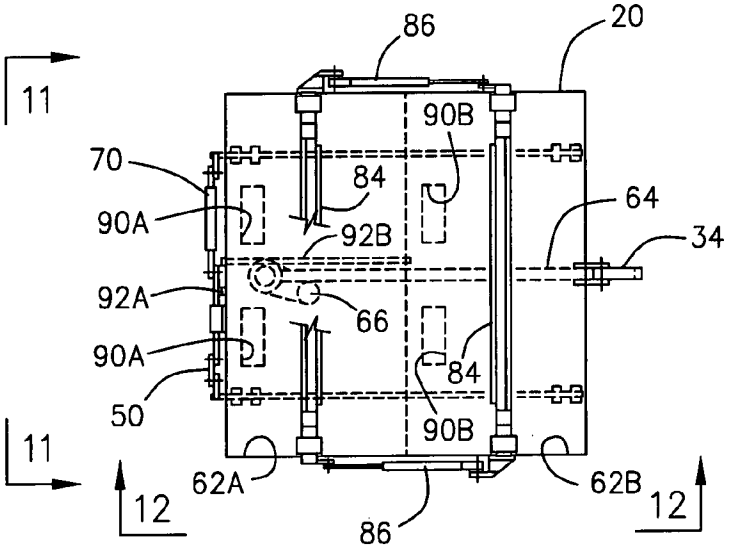
FIG. 10 is a top plan view of the float sinker.
Figure 11:
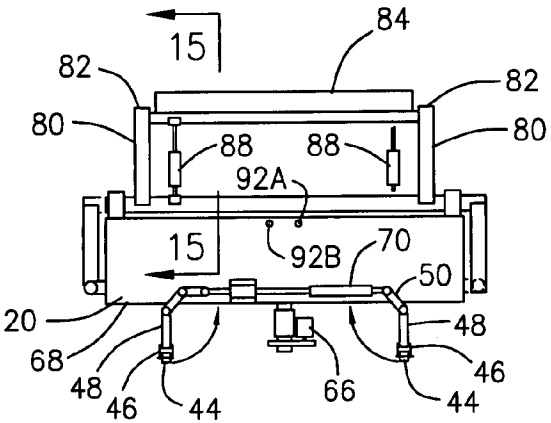
FIG. 11 is an end view of the float sinker of FIG. 10 taken along line 11—11.

FIGS. 10 and 11 show the landing gear 50 in more detail, including the hydraulic landing gear cylinder 70 that attaches to and serves to deploy and retract the legs 48 of the landing gear 50. These figures also show the leg rollers 44 provided on the lower end 46 of each of the four retractable legs 48. The purpose of the landing gear 50 is to support the float sinker 20 as it rests on the barge table 24 and to assist in loading and unloading the float sinker 20 from the barge table 24. The legs 48 of the landing gear 50 must be retracted against the bottom 68 of the float sinker 20 so they are out of the way of the boom 22 when the barge 10 is in use so that the float sinker 20 can be rotated by the boom 22 and by the hydraulic rotator motor 66 that is also located on the bottom 68 of the float sinker 20.

Figure 7:
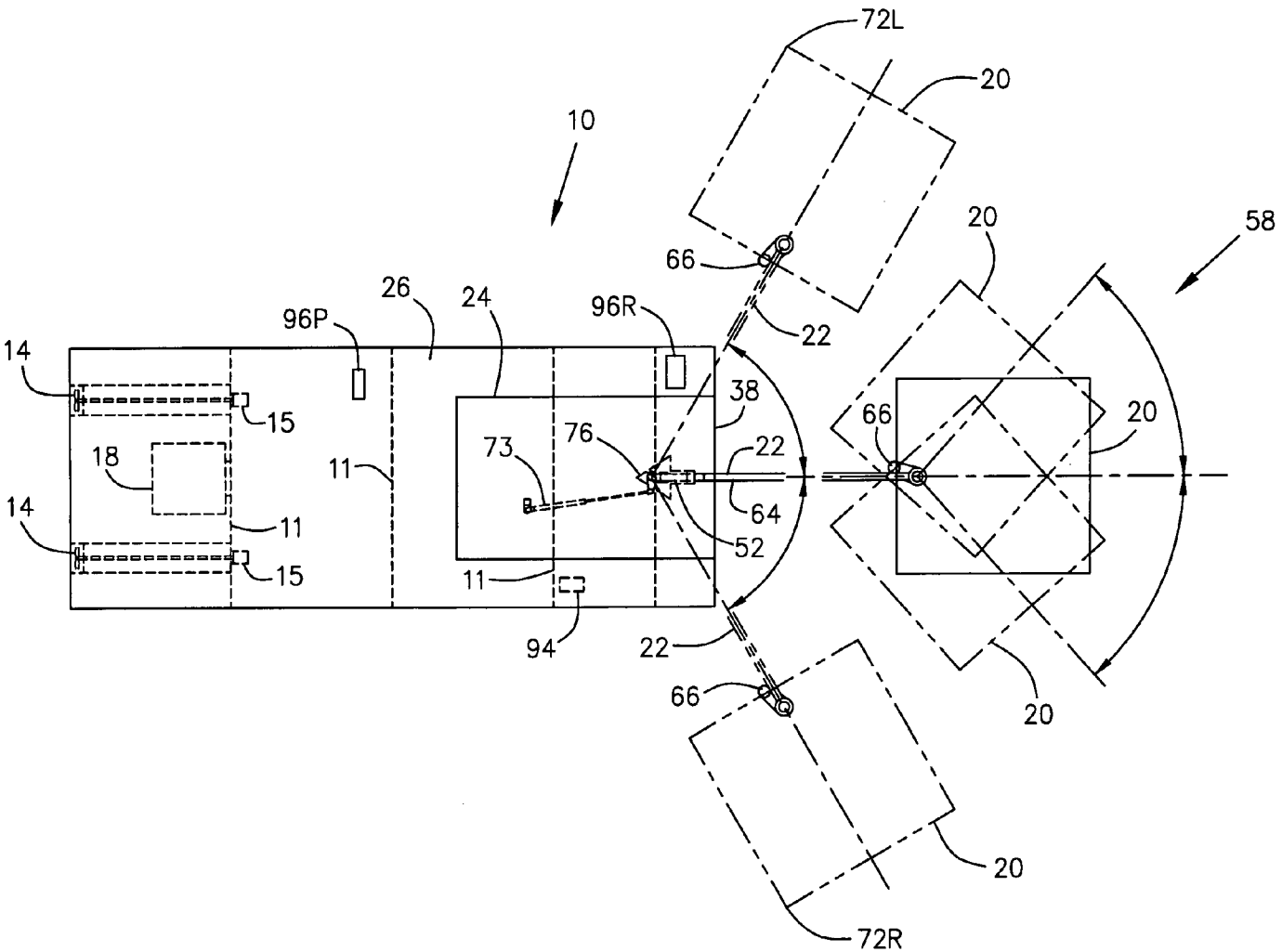
FIG. 7 is a top plan view of the foam block replacement barge of FIG. 6 showing the two rotational capabilities of the float sinker.

FIG. 7 illustrates how the float sinker 20 can be moved from side to side, as shown by the position of the float sinker 20 associated with numerals 72L and 72R, relative to the barge 10 by moving the boom 22 from side to side. A hydraulic boom cylinder 73 provided on the barge 10 rotates a rotary segment 74 that attaches via the joint 60 to the boom rotator segment 52 and thereby moves the boom 22 and the attached float sinker 20 from side to side. As illustrated in FIGS. 1, and 7, the barge 10 is preferably provided with a triangular shaped indented area 76 at the front end 54 of the barge 10. The rotary segment and joint 60 are located in the triangular shaped indented area 76 which allows the boom 22 to rotate freely left and right relative to the barge 10 without having the boom 22 coming into contact with the hull 78 of the barge 10.

FIG. 7 also illustrates how the float sinker 20 can be rotated by actuating the hydraulic rotator motor 66 that is provided at the bottom 68 of the float sinker 20 for this purpose. The hydraulic rotator motor 66 rotates the float sinker 20 relative to the boom 22. Together by moving the boom 22 left or right via activation of the hydraulic boom cylinder 73 and by rotating the float sinker 20 relative to the boom via activation of the hydraulic rotator motor 66, the operator can maneuver the float sinker 20 under a floating structure to properly position it so that it can remove and replace foam blocks 12 from under the floating structure.

Also, the propellers 14 that are provided on the barge 10 can, in addition to their normal function of steering the barge 10, be used separately or together to simultaneously move both the barge 10 and float sinker 20 forward or backward or be used to simultaneously turn both the barge 10 and the float sinker 20 left or right in the water 16.

Figure 12:
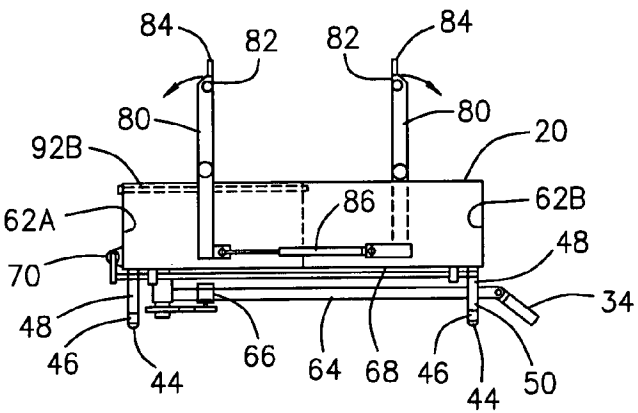
FIG. 12 is a side view of the float sinker of FIG. 10 taken along line 12—12.
Figure 15:
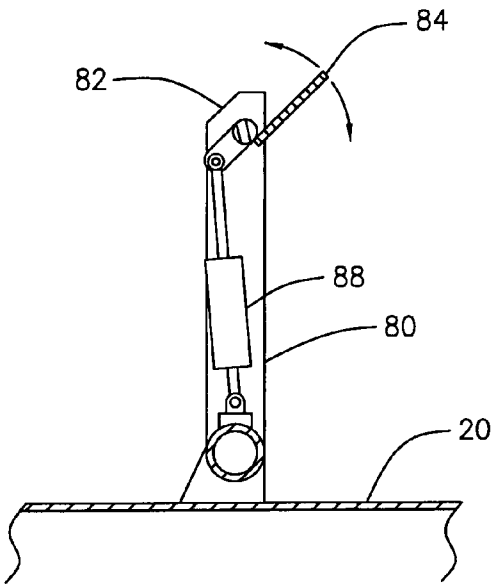
FIG. 15 is an enlarged view of one of the clamp arms showing its flat locking plate and the hydraulic cylinder that moves the locking plate.

Referring now to FIGS. 8 and 9, the float sinker 20 has a pair of movable clamp arms 80, with each clamp arm 80 provided at an upper end 82 with a movable flat plate 84 for releasably grasping a foam block 12. Each clamp arm 80 is attached to and actuated by a hydraulic clamp arm cylinder 86. This is best illustrated in FIG. 12. Also, each movable flat plate 84 is attached to and actuated by a hydraulic plate cylinder 88. This is best illustrated in FIGS. 11 and 15.

Figure 14:
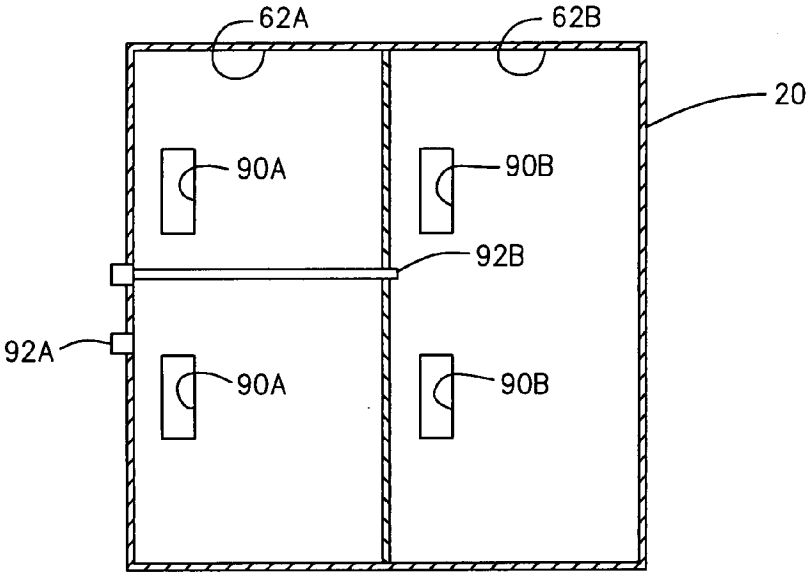
FIG. 14 is a cross sectional view of the float sinker of FIG. 13 taken along line 14—14.
Figure 13:
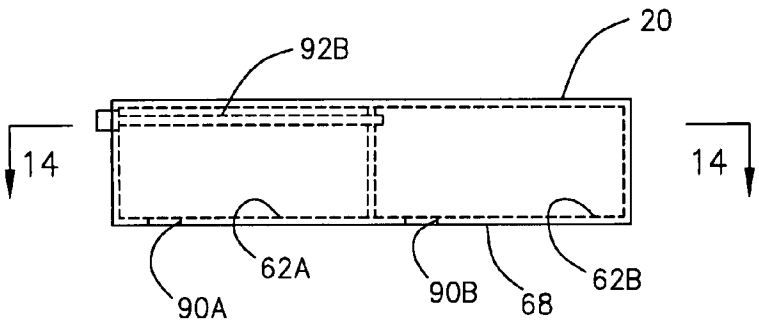
FIG. 13 is a side view of the float sinker with the clamp arms and landing gear removed.

FIGS. 10, 13 and 14 show the float sinker 20 in more detail. The float sinker 20 is provided with two hollow chambers 62A and 62B that can be flooded, respectively, via water openings 90A and 90B provided in the bottom 68 of the float sinker 20. Flooding the chamber 62A and 62B adds sufficient weight to the float sinker 20 to allow the float sinker 20 to move downward in the water 16 and thereby serves as a means for pulling an attached foam block 12 downward in the water 16.

Each chamber 62A and 62B of the float sinker 20 is provided with an air line 92A and 92B that supplies air to and from the chambers 62A and 62B, respectively, from an air pump 94 provided on the barge 10 as a means of controlling admission of water 16 into the chambers 62A and 62B and as a means of expelling water 16 from the chambers 62A and 62B. When the water 16 is expelled from the chambers 62A and 62B, the float sinker 20 becomes buoyant enough to allow the float sinker 20 and an attached foam block 12 to again rise to the surface of the water 16. In the interest of making the drawings easy to understand, air line connections between the air pump 94 and the air lines 92A and 92B on the float sinker 20 have been omitted from the illustrations, and also, hydraulic connections between the motor 18 on the barge 10 and the float sinker 20 have been omitted from the illustrations. The two chambers 62A and 62B can be selectively and independently flooded to allow the operator to control and balance the descent and ascent of the float sinker 20 and the attached foam block 12 as they move downward and upward in the water 16.

The barge 10 is provided with two sets of controls 96P and 96R so that an operator can operate the barge 10 and can remotely operate the float sinker 20 from the deck 26 of the barge 10. FIG. 1 illustrates the location of the permanent set of controls 96P that are used by the operator when the barge 10 is in its non-deployed transport position 28, and FIGS. 1, 8, and 9 illustrate the location of the removable set of operator controls 96R that are employed when the barge 10 is in it deployed, in use position 58.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A foam block replacement barge comprising:

a barge for floating on water, one end of a boom attached to the barge and an opposite end of the boom attached to a float sinker for moving the float sinker in the water from side to side relative to the barge, floatation means provided on the float sinker for raising and lowering the float sinker in the water, movable clamp arms provided on the float sinker for releasably grasping a foam block, said boom attached to said barge via a first articulating joint that allows the boom to move freely upward and downward in the water, and said boom provided with a second articulating joint that allows the float sinker to move freely upward and downward in the water.

2. A foam block replacement barge comprising:

a barge for floating on water, one end of a boom attached to the barge and an opposite end of the boom attached to a float sinker for moving the float sinker in the water from side to side relative to the barge, floatation means provided on the float sinker for raising and lowering the float sinker in the water, movable clamp arms provided on the float sinker for releasably grasping a foam block, and rotational means provided on the float sinker for rotating the float sinker relative to the barge.

3. A foam block replacement barge according to claim 2 further comprising:

retractable landing gear provided on said float sinker to support the float sinker on a barge table provided on a deck of the barge when the boom that attaches the float sinker to the barge is detached from the barge and the float sinker is resting on the barge in its non-deployed, transport position.

4. A foam block replacement barge comprising:

a barge for floating on water, one end of a boom attached to the barge and an opposite end of the boom attached to a float sinker for moving the float sinker in the water from side to side relative to the barge, floatation means provided on the float sinker for raising and lowering the float sinker in the water, movable clamp arms provided on the float sinker for releasably grasping a foam block, said floatation means provided on the float sinker for raising and lowering the float sinker in the water further comprising at least two compartments provided internally within the float sinker and air lines connecting to each said compartment to supply air to and remove air from the compartment as a means of reversibly providing buoyancy to the float sinker and the foam block that may be attached to the float sinker, propellers provided on the barge for moving and steering the barge in the water, and a winch attached to a deck of the barge, a winch cable provided on the winch and removably attached to a float sinker boom segment of the boom as a means of lowering the float sinker off of a barge table into the water when the barge table is tilted to deploy the float sinker and as a means of again raising the float sinker out of the water onto the tilted barge table to recover the float sinker onto the deck of the barge.

* * * * *